US005090396A

United States Patent [19]

Bickel et al.

[11] Patent Number: 5,090,396

[45] Date of Patent: Feb. 25, 1992

[54] ADJUSTABLE ARCHERY STABILIZER

[76] Inventors: Wayne J. Bickel, Rte. 1, Box 241, Geneva, Ind. 46740; Richard L. White, 109 Smith St., Yorktown, Ind. 47396

[21] Appl. No.: 618,385

[22] Filed: Nov. 27, 1990

[51] Int. Cl.[5] ..... F41B 5/00

[52] U.S. Cl. ..... 124/89; 124/88

[58] Field of Search ..... 124/23.1, 24.1, 25.6, 124/86, 88, 89

[56] References Cited

U.S. PATENT DOCUMENTS

| | | | |
|---|---|---|---|
| 3,468,297 | 9/1969 | Cress | 124/89 X |
| 3,524,441 | 8/1970 | Jeffery | 124/24.1 |
| 3,589,350 | 6/1971 | Hoyt et al. | 124/89 |
| 3,804,072 | 4/1974 | Izuta | 124/24.1 |
| 4,054,121 | 10/1977 | Hoyt | 124/89 |
| 4,135,486 | 1/1979 | Enomoto | 124/89 |
| 4,245,612 | 1/1981 | Finlay | 124/89 |
| 4,478,204 | 10/1984 | Kocsan | 124/89 |
| 4,615,327 | 10/1986 | Saunders | 124/89 |
| 4,779,602 | 10/1988 | Hess | 124/89 |

*Primary Examiner*—Randolph A. Reese
*Assistant Examiner*—John Ricci
*Attorney, Agent, or Firm*—Baker & Daniels

[57] ABSTRACT

A stabilizer which may be attached to an archery bow. The stabilizer includes three elongated parallel rods with two end caps for interconnecting the three rods. An axial slider is mounted on the rods and may be secured at any desired axial position of the rods. The rods may be rotationally adjusted relative to the bow by means of a rotational adjustment which includes a locking nut.

20 Claims, 2 Drawing Sheets

ADJUSTABLE ARCHERY STABILIZER

BACKGROUND OF THE INVENTION

This invention relates generally to an archery accessory and more particularly to an archery stabilizer which is adapted to be attached to an archery bow for the purpose of reducing vibration and torque of the bow and for producing greater accuracy in the shooting of arrows with such an archery bow.

Prior art stabilizers for archery bows have been known for many years. If a bow does not include such a stabilizer mounted thereon, there is a tendency for the bow to be laterally and rotationally displaced upon the release of an arrow from the bow. During this lateral and rotational displacement, the handle section of the bow tends to move in a vibrating manner in the direction away from the arrow as it passes the bow handle. Since the arrow is affected continuously throughout the time that the bow string is moving from its drawn position to its forwardmost position, due to the constant pressure exerted on the arrow nock by the bow string, it follows that any concurrent rotational displacement of the handle section or the arrow rest of the bow during this period will ultimately effect the resulting cast of the arrow. Thus it is desired to provide a stabilizer for a bow which reduces the lateral and rotational displacement of the bow and thereby results in greater shooting accuracy.

Efforts have been made in the past to achieve the foregoing purpose by the provision of weighted elements rigidly attached to the bow by various means. However, for the most part these prior art efforts have fallen short of providing the necessary stabilizing and dampening action required to achieve the most consistent and accurate arrow passage from the bow. It is therefore desired to provide an improved stabilizer which provides improved damping action to efficiently and effectively absorb as much of the vibrating energy of the bow as is possible during the use of the bow.

Some prior art stabilizers have been adjustable. One adjustment which has been provided in prior art stabilizers has been the addition or deletion of the amount of weight carried by the stabilizer. While this arrangement is desirable, it is furthermore desired to provide additional adjustment of a stabilizer to match the weight of a bow as well as the tension of the bow string. Prior art stabilizers have not been able to satisfy this need.

It is known that a limited degree of bow rotation is necessary to insure proper passage of the arrow from the bow. It is therefore also desired to provide a stabilizer wherein the amount of bow rotation can be controlled by adjustment of the stabilizer.

SUMMARY OF THE INVENTION

The present invention provides a stabilizer consisting of a plurality of elongated parallel rods, the ends of which are interconnected by means of end caps. Additionally, a slider or sleeve is adjustably mounted on the rods which can be adjusted and secured in any desired axial position along the rods. Still further provision is made for rotationally adjusting the position of the rods relative to the bow. Lastly, an adjustable weight can be mounted at the end of the stabilizer.

An advantage of the present invention is that by the use of multiple rods the damping action of the stabilizer is more effective than was the case with prior art stabilizers. The rods, upon absorption of the shock caused by shooting an arrow, will vibrate and in effect support a standing wave. By providing an axially adjustable slider for the rods, a node can be introduced into the vibrating rods to tune the rods whereby the shock absorbing capability of the stabilizer can be optimized. The axial slider can be secured to one of the rods in any selected axial position In the case of use of a stabilizer having three rods, the axial slider can be connected to one of the rods, thus providing a rigid node for that rod. The additional two rods can move somewhat within the apertures of the adjustable sleeve. By providing rotational adjustment for the rod assembly relative to the bow, the rotation effect of the bow can be affected as desired. Lastly, by adding various weights, the characteristics of the stabilizer can be further adjusted.

The present invention, in one form thereof, comprises a plurality of elongated parallel rods and a means for securing the rods to a bow.

The present invention, in one form thereof, comprises a plurality of elongated parallel rods, means for securing the rods to a bow and an axial adjustment means mounted on the plurality of rods for axial adjustment relative to the rods.

The present invention, in one form thereof, comprises a stabilizer including three elongated parallel rods, a first end cap for securing first ends of the rods and a fastening means connected to the first end cap for securing the stabilizer to a bow. A rotational adjustment means is connected to the fastening means for adjusting the rotational position of the plurality of rods with respect to the bow. An axial adjustment means is adjustably mounted on the rods for axial adjustment relative to the rods.

It is an object of the present invention to provide a bow stabilizer which includes a plurality of parallel rods.

It is a further object of the present invention to provide a stabilizer having multiple parallel rods and which includes an axial slider and which can be positioned at various axial positions along the rods.

A still further object of the present invention is to provide a stabilizer for a bow which is rotationally adjustable to effect the rotational characteristics of a bow.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 3:
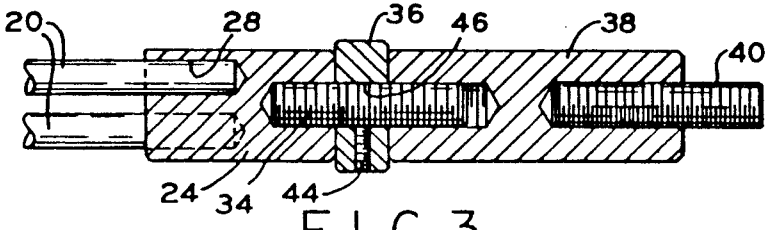
FIG. 3 is an enlarged cross-sectional view of a portion of the stabilizer of FIG. 2 taken along line 3—3 thereof.

Corresponding reference characters indicate corresponding parts throughout the several views. The exemplifications set out herein illustrate preferred embodiments of the invention, in one form thereof, and such exemplifications are not to be construed as limiting the scope of the invention in any manner.

DESCRIPTION OF THE PREFERRED EMBODIMENT

Figure 1:
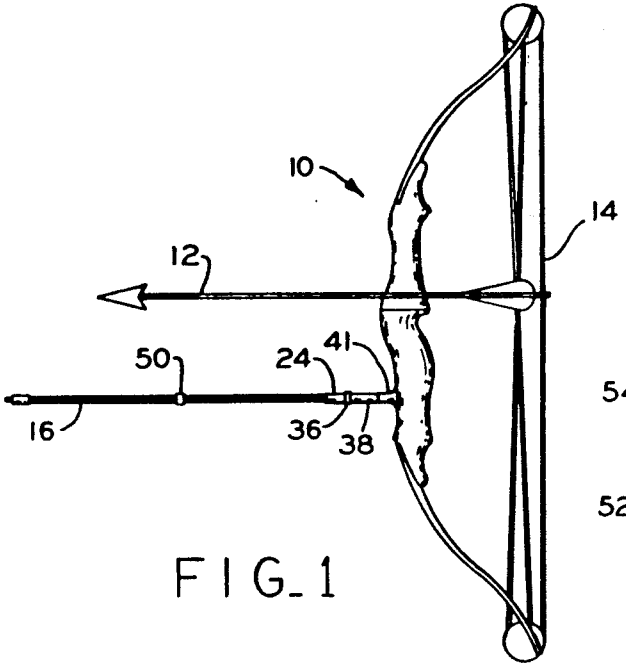
FIG. 1 is an elevational view of a bow with a stabilizer mounted thereon.

Referring to FIG. 1 there is seen a bow 10 having a bow string 14 on which an arrow 12 rests. A stabilizer 16 is secured to the front of bow 10.

Referring now to FIGS. 2-5, the stabilizer includes three parallel elongated rods 20. The rods are connected at their distal ends by means of an end cap 22 and at their proximal ends by means of an end cap 24. Distal end cap 22 includes three apertures 26 in which the rods are secured by means of any suitable means such as for instance epoxy cement. Similarly proximal end cap 24 includes three apertures 28 for receiving the proximal ends of rods 20. Proximal ends of rods 20 are secured in apertures 28 by any suitable means such as for instance epoxy cement. The rods 20 are fairly rigid and, in a preferred embodiment, are composed of graphite such as is commonly used in arrows, fishing rods, and the like. Alternatively, the rods 20 may be made of other types of materials such as aluminum or fiberglass. It should also be noted that, in the interest of making the stabilizer lightweight, the rods 20 are hollow. In one embodiment used successfully by the inventors, the rods are ¼ inch in diameter and are 20 inches long. The end caps 22 and 24 are preferably made of a lightweight metal such as for instance aluminum. However, the end caps may be made of other materials such as for instance lightweight magnesium, fiberglass, or the like. Distal cap 22 by suitable means such as for instance by means of a suitable adhesive. Stud 30 is threaded whereby it can receive a weight 32 for varying the weight of the stabilizer. Weight 32 may be selected for best performance of the stabilizer for a particular bow.

While in the disclosed embodiment three rods 20 are shown, alternatively another number of rods may be used such as for instance two or four rods.

A second stud 34 is secured to proximal end cap 24 by means of an adhesive or other suitable means. Stud 34 is adapted to receive a locking nut 36. Stud 34 furthermore is adapted to be threaded into mounting section 38. In turn mounting section 38 includes a threaded stud 40 which is adapted to engage with a mounting portion 41 of a bow 10. Stud 40 is threaded into a threaded aperture 42 of mounting portion 41.

Figure 5:
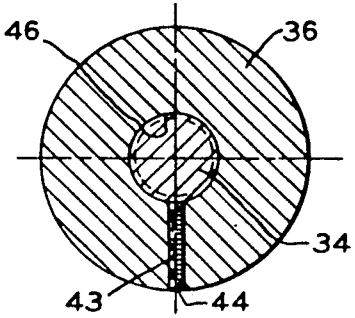
FIG. 5 is a cross-sectional view of the rotational adjuster of the stabilizer of FIG. 2 taken along line 5—5 thereof.

FIG. 5 shows, in cross-section, locking nut 36. Locking nut 36 includes a threaded aperture 46 for threading onto stud 34. Locking nut 36 also includes threaded aperture 43 for receiving a set screw 44. Thus, by tightening set screw 44, locking nut 36 can be secured at any axial position on stud 34. By referring to FIG. 3, it can be seen that proximal end cap 24 has been tightened against lock nut 36 which in turn has been tightened against mounting section 38. It can be seen that end cap 24 ma be rotated relative to locking nut 36 and mounting section 38 whereby stud 34 will be rotated inside nut 36 and the threaded aperture of mounting portion 38. Thus, it is possible for rods 20 and end caps 22 and 24 to be rotated relative to mounting section 38 and to be locked in any rotated position b means of lock nut 36.

Figure 4:
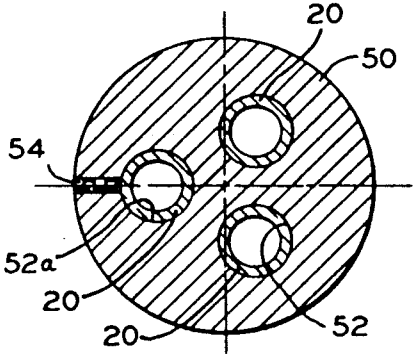
FIG. 4 is a cross-sectional view of the axial adjustment sleeve of the stabilizer of FIG. 2 taken along line 4—4 thereof.
Figure 2:
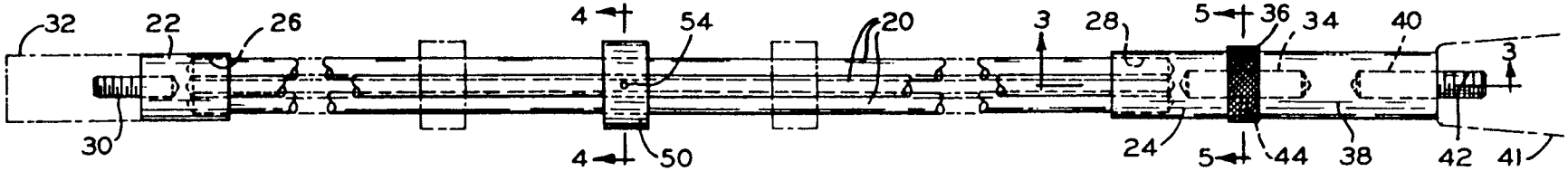
FIG. 2 is an elevational view of a stabilizer according to the present invention.
Figure 6:
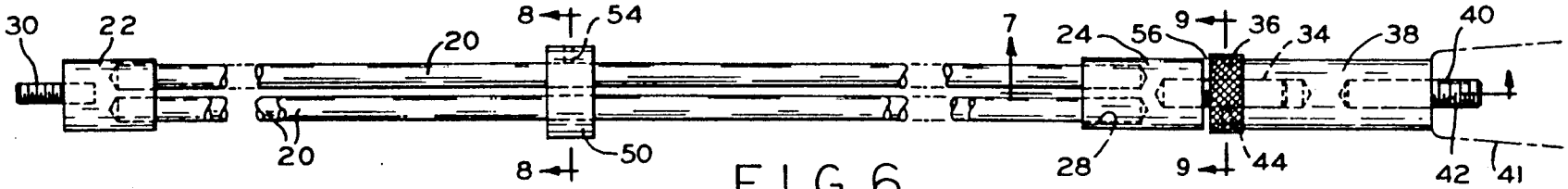
FIG. 6 is an elevational view of the stabilizer of FIG. 2 wherein the rotational adjuster has been rotated and locked in place.
Figure 9:
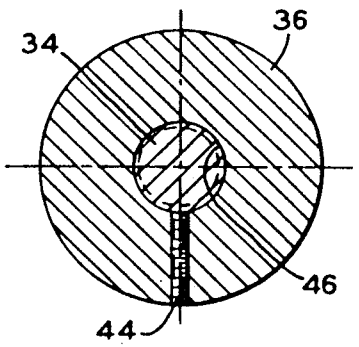
FIG. 9 is an enlarged cross-sectional view of the rotational adjuster of the stabilizer of FIG. 6 taken along line 9—9 thereof.
Figure 8:
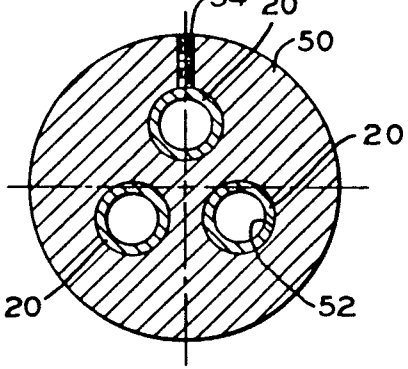
FIG. 8 is an enlarged cross-sectional view of the axial adjustment sleeve of the stabilizer of FIG. 6 taken along line 8—8 thereof.
Figure 7:
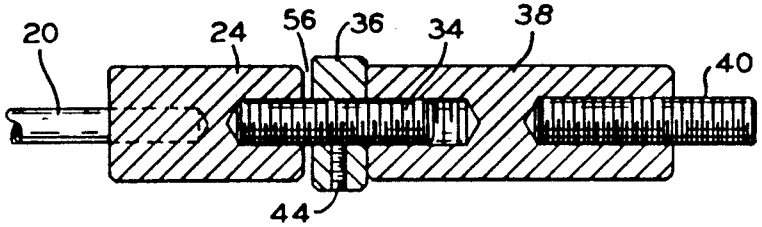
FIG. 7 is an enlarged cross-sectional, enlarged view of the rotational adjustment portion of the stabilizer of FIG. 6 taken along line 7—7 thereof.

Referring now to FIGS. 2 and 4, it can be seen that a slider 50 is positioned on rods 20. Slider 50 includes three apertures 52 which receive respectively rods 20. Slider 50 also includes a threaded aperture for receiving a set screw 54. By tightening set screw 54, the axial position of slider 50 on rods 20 can be fixed. When set screw 54 is tightened, slider 50 is secured to the rod 20 which is received in aperture 52*a* of slider 50. The fit of rods 20 in apertures 52 is such that slider 50, after loosening of set screw 54, can be easily adjusted axially with respect to rods 20.

By adjusting slider 50, it can be seen that the rod structure can be tuned for the vibrations generated when an arrow is shot from the bow. These vibrations set up standing waves in rods 20. By adjusting slider 50, it can be seen that the node created by the slider in the rods is adjustable relative to the length of the rods, thus tuning rods 20. Thus by properly tuning the rod structure it is noted that the structure can be adjusted to be maximally effective in dampening the vibrations and absorbing the energy generated by the vibrating bow string. Thus the entire structure can be adjusted for bows of various sizes, poundages, and bow string tensions.

Referring now to FIGS. 6-9 the stabilizer structure as shown wherein the locking nut 36 has been adjusted and the entire stabilizer has been rotated relative to the position disclosed in FIG. 2. By first rotating end cap 24, rods 20, and end cap 22 relative to the lock nut until a space 56 exists between the lock nut 36 and end cap 24, the slider 50 will also have been rotated so that set screw 54 has been rotated through 90°. If this is the selected rotational position of slider 50, the lock nut 36 is now threaded firmly against mounting 38 to lock the rod and end cap structure against further rotation. The Applicants have found that by selecting the rotational position of slider 50, the archer can select which side of the stabilizer is to be the stiff side i.e. where the set screw 54 is located, so that the pattern of the arrows shot by the bow can be changed to suit the archer.

Figure 10:
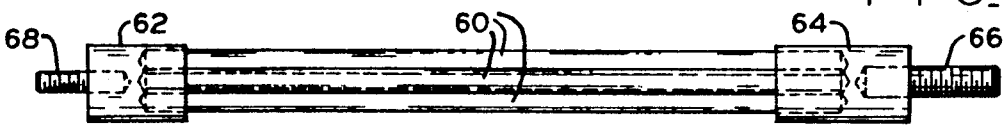
FIG. 10 is an elevational view of an alternative embodiment of a stabilizer.

Referring now to FIG. 10, an alternate embodiment of the stabilizer is shown. In this embodiment the slider 50 has been eliminated. Furthermore, rods 60 are substantially shorter than in the embodiment of the stabilizer shown in FIGS. 1-9. For instance the rods in the embodiment of FIG. 10 are 6 inches long. End caps 62 and 64 are provided similarly to end caps for the embodiment of FIGS. 1-9. Similarly a stud 68 is provided for mounting of various weights and a stud 66 is provided to thread the stabilizer into the mounting portion 41 of a bow. The stabilizer shown in FIG. 10 may be used for hunting bows since the long stabilizer shown in FIGS. 1-9 would not be suitable for the hunting environment. In connection with the stabilizer of FIG. 10, the stabilizer should be selected for the particular bow since there is no adjustment by means of a slider 50, either axially or rotatably.

Figure 11:
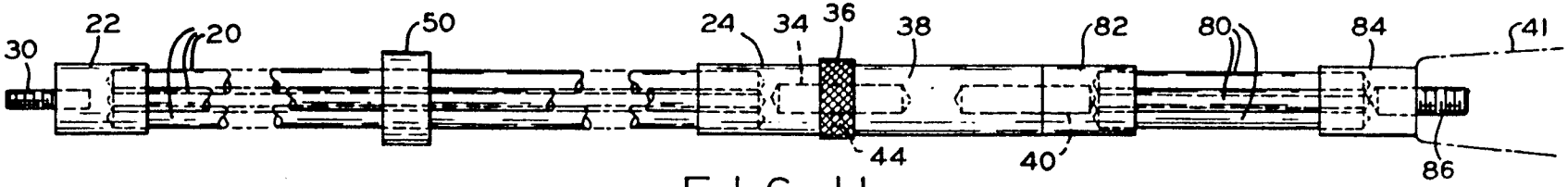
FIG. 11 is an elevational view of a stabilizer including an alternative mounting section.

Still a further embodiment of the stabilizer is shown in FIG. 11. In this embodiment mounting section 38 has been replaced by means of mounting section 78 having rods 80 and end caps 82 and 84. End cap 84 is secured to mounting portion 41 by means of a threaded stud 86. By use of the additional mounting section 78, further vibration is absorbed by the stabilizer.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A stabilizer adapted to be attached to an archery bow comprising:

a plurality of elongated parallel rods, said rods including first ends and second ends;

first interconnecting means and second interconnecting means for respectively interconnecting said rod first ends and said rod second ends, said rods held substantially parallel and spaced apart to define an assembly; and securing means for securing said assembly to a bow.

2. The stabilizer according to claim 1 including an axial adjustment means axially adjustably mounted on said plurality of rods for axial adjustment relative to said rods.

3. The stabilizer according to claim 2 wherein said axial adjustment means comprises a sleeve, said sleeve including a plurality of apertures therein, each said apertures adapted to respectively receive a said rod therein.

4. The stabilizer according to claim 3 wherein said sleeve includes locking means for locking said sleeve axially in place relative to said plurality of rods.

5. The stabilizer according to claim 4 wherein said locking means comprises means for securing said sleeve to one of said rods.

6. The stabilizer according to claim 1 wherein said first interconnecting means comprises an end cap, said end cap including means for receiving a weight.

7. The stabilizer according to claim 1 wherein said securing means includes a rotational adjustment means for adjusting the rotational position of said plurality of rods with respect to said bow.

8. A stabilizer adapted to be attached to an archery bow comprising:

a plurality of elongated parallel rods, said rods including first ends and second ends;

first interconnecting means and second interconnecting means for respectively interconnecting said rod first ends and said rod second ends whereby said rods are held substantially parallel and spaced apart to define an assembly;

securing means for securing said assembly to a bow; and axial adjustment means mounted on said plurality of rods for axial adjustment relative to said rods.

9. The stabilizer according to claim 8 wherein said axial adjustment means comprises a sleeve, said sleeve including a plurality of apertures therein for respectively receiving said rods therein.

10. The stabilizer according to claim 9 wherein said sleeve includes locking means to lock said sleeve axially in place relative to said plurality of rods.

11. The stabilizer according to claim 10 wherein said locking means comprises means to secure said sleeve to one of said rods.

12. The stabilizer according to claim 8 wherein said first interconnecting means comprises an end cap, said end cap including means for receiving a weight.

13. The stabilizer according to claim 8 wherein said securing means includes means for adjusting the rotational position of said plurality of rods with respect to said bow.

14. A stabilizer adapted to be attached to an archery bow comprising:

three elongated parallel rods;

a first end cap for securing first ends of said rods;

fastening means connected to said first end cap for securing said stabilizer to a bow;

rotational adjustment means connected to said fastening means for adjusting the rotational position of said plurality of rods with respect to said bow; and axial adjustment means adjustably mounted on said rods for axial adjustment relative to said rods.

15. The stabilizer according to claim 14 wherein said axial adjustment means comprises a sleeve, said sleeve including three of apertures therein for respectively receiving said three rods therein.

16. The stabilizer according to claim 15 wherein said sleeve includes locking means for locking said sleeve axially in place relative to said three rods.

17. The stabilizer according to claim 16 wherein said locking means comprises means for securing said sleeve to one of said rods.

18. The stabilizer according to claim 14 including a second end cap connected to second ends of said rods for securing said second ends of said three rods.

19. The stabilizer according to claim 18 wherein said second end cap includes means for receiving a weight.

20. The stabilizer according to claim 14 wherein said rotational adjustment means includes locking means for locking said rotational adjustment means in a selected rotated position.

* * * * *